United States Patent [19]

Ohtsuka et al.

[11] Patent Number: 4,981,616

[45] Date of Patent: Jan. 1, 1991

[54] SPENT FUEL TREATMENT METHOD

[75] Inventors: Katsuyuki Ohtsuka; Isao Kondoh; Toru Suzuki, all of Tokai, Japan

[73] Assignee: Doryokuro Kakunenryo Kaihatsu Jigyodan, Tokyo, Japan

[21] Appl. No.: 400,220

[22] Filed: Aug. 29, 1989

[30] Foreign Application Priority Data

Sep. 5, 1988 [JP] Japan ..... 63-222100

[51] Int. Cl.[5] ..... G21F 9/04

[52] U.S. Cl. ..... 252/632; 252/631; 252/364; 210/770; 210/774; 423/10

[58] Field of Search ..... 252/632, 631, 364; 210/770, 774; 423/10

[56] References Cited

U.S. PATENT DOCUMENTS 3,205,588 9/1965 Oetjen et al. ..... 252/630 X 3,281,371 10/1966 Nerge et al. ..... 252/632

3,361,649 1/1968 Karter ..... 252/632 X 3,725,293 4/1973 Haas ..... 252/643

4,043,936 8/1977 Francis et al. ..... 252/631

4,225,455 9/1980 Haas ..... 252/631

4,364,859 12/1982 Ohtsuka et al. ..... 252/643

4,444,723 4/1984 Matsumaru et al. ..... 422/159

*Primary Examiner*—Edward A. Miller

*Assistant Examiner*—Ngoclan T. Mai

*Attorney, Agent, or Firm*—Armstrong, Nikaido, Marmelstein, Kubovcik & Murray

[57] ABSTRACT

In a method for recovering plutonium and uranium from spent nuclear fuel by solvent extraction having solvent consisting of tri-n-butyl phosphate, dibutyl phosphate and n-dodecane, the improvement comprises separating the n-dodecane from the phosphate by freeze-drying and separating the phosphate from each other and residual impurities by fractional distillation.

1 Claim, 1 Drawing Sheet

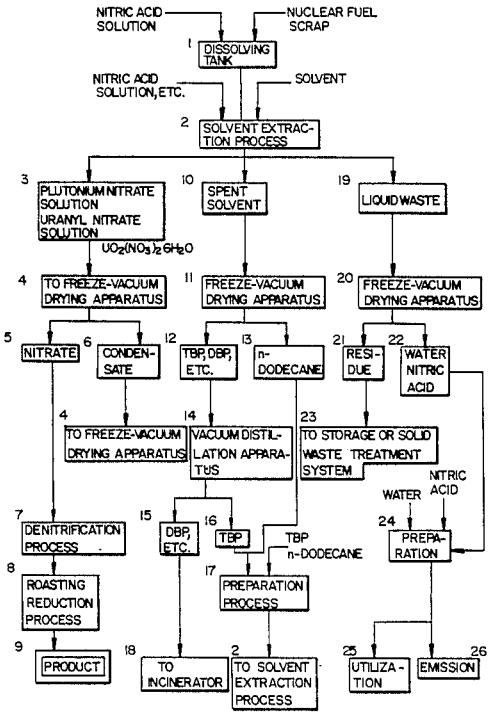

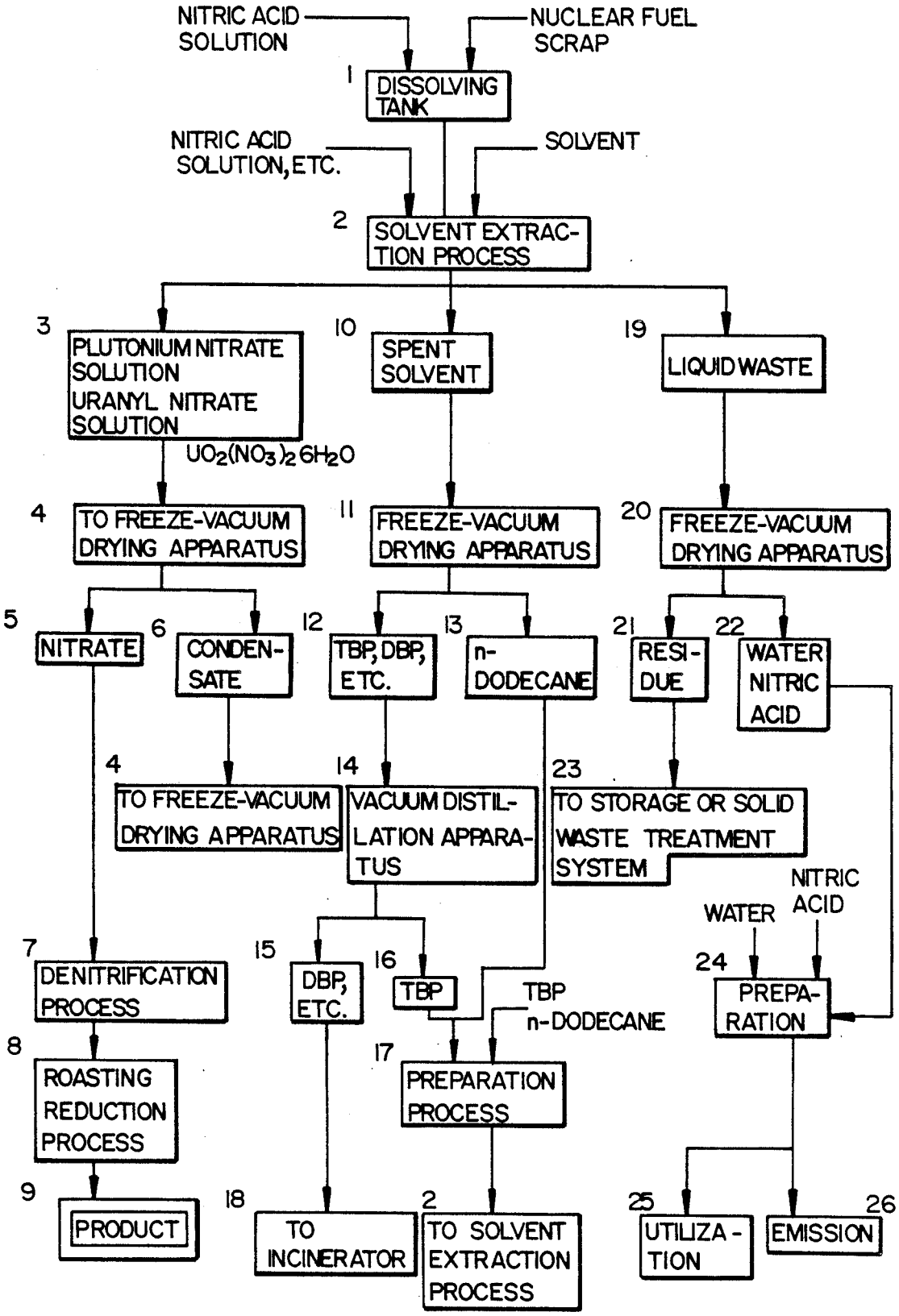
NITRIC ACID SOLUTION
NUCLEAR FUEL SCRAP
1
DISSOLVING TANK
NITRIC ACID SOLUTION, ETC.
SOLVENT
2
SOLVENT EXTRACTION PROCESS
3
PLUTONIUM NITRATE SOLUTION
URANYL NITRATE SOLUTION
$UO_2(NO_3)_2 6H_2O$
10
SPENT SOLVENT
19
LIQUID WASTE
4
TO FREEZE-VACUUM DRYING APPARATUS
11
FREEZE-VACUUM DRYING APPARATUS
20
FREEZE-VACUUM DRYING APPARATUS
5
NITRATE
6
CONDENSATE
12
TBP, DBP, ETC.
13
n-DODECANE
21
RESIDUE
22
WATER NITRIC ACID
4
TO FREEZE-VACUUM DRYING APPARATUS
14
VACUUM DISTILLATION APPARATUS
23
TO STORAGE OR SOLID WASTE TREATMENT SYSTEM
WATER
NITRIC ACID
7
DENITRIFICATION PROCESS
15
DBP, ETC.
16
TBP
TBP
n-DODECANE
24
PREPARATION
8
ROASTING REDUCTION PROCESS
17
PREPARATION PROCESS
9
PRODUCT
18
TO INCINERATOR
2
TO SOLVENT EXTRACTION PROCESS
25
UTILIZATION
26
EMISSION

SPENT FUEL TREATMENT METHOD

BACKGROUND OF THE INVENTION

This invention relates to a method of treating spent fuel utilizable in a spent nuclear fuel retreatment process, scrap nuclear fuel wet reclamation process, etc.

Ordinarily, in spent nuclear fuel re-treatment and scrap nuclear fuel wet reclamation processes, organic solvent used in an extraction process is degraded by the effects of acidity and radiation. Consequently, the degraded products are removed from the organic solvent by a solution of sodium hydroxide or sodium carbonate, after which the solvent is reused.

Certain shortcomings, however, exist in such conventional methods. These are as follows:

(1) Reclamation of organic solvent in which there is advanced deterioration is impossible, and the solvent becomes a liquid radioactive waste that is difficult to treat.

(2) A solution containing sodium is mixed with radioactive liquid waste of the nitrate family, after which the resulting solution is reduced in volume and solidified in glass or asphalt. However, owing to the large amount of sodium contained, the reduction in volume has its limitations. This also accounts for complicated solidification treatments.

In view of the foregoing, there is a need to develop a process which minimizes the use of sodium as well as a solvent reclamation process.

Further, though evaporation cans are used to concentrate radioactive material in treatment of liquid radioactive wastes, these are disadvantageous because decontamination is inefficient and the cans are subject to considerable corrosion. It is desired, therefore, that a treatment process with a higher decontaminating efficiency and less corrosion be developed.

SUMMARY OF THE INVENTION

This invention has been devised to solve the foregoing problems and its object is to provide a method of treating spent fuel in which a salt-free process is capable of being employed.

Another object of the invention is to provide a method of treating spent fuel in which, by using a freeze-vacuum drying process, material corrosion is eliminated by operation at low temperatures, safety is enhanced by eliminating the danger of fire, explosion and the like, and use of organic substances containing sodium is minimized to enable reduction and simplification of equipment for asphalt and glass solidification.

Still another object of the invention is to provide a method of treating spent fuel in which recovered solution can be reutilized and liquid radioactive waste reduced in volume.

A further object of the invention is to provide a method of treating spent fuel in which solvent can be reutilized and liquid radioactive waste reduced in volume by employing a vacuum distillation process, which has a high decomtamination efficiency, in the recovery of the solvent.

The invention provides a method of treating spent fuel in a spent nuclear fuel retreatment process and scrap nuclear fuel wet reclamation process, characterized by separating a spent solvent of a solvent cleansing process into tri-n-butyl phosphate (hereinafter referred to as TBP), n-dodecan and dibutyl phosphate (hereinafter referred to as DBP) by using a freeze-vacuum drying process and vacuum distillation process.

Further, the invention provides a method of treating spent fuel in a spent nuclear fuel retreatment process and scrap nuclear fuel wet reclamation process, characterized by separating a liquid radioactive waste into liquid and residue by using a freeze-vacuum drying process in treatment of the liquid radioactive waste.

Further, the invention provides a method of treating spent fuel in a spent nuclear fuel retreatment process and scrap nuclear fuel wet reclamation process, characterized by obtaining a nitrate by powdering a plutonium solution and a uranium solution using a freeze-vacuum drying process, denitrifying the nitrate and subjecting the same to roasting reduction to obtain an oxide powder.

Other features and advantages of the present invention will be apparent from the following description taken in conjunction with the accompanying drawing.

BRIEF DESCRIPTION OF THE DRAWING

The sole FIGURE is a view showing an embodiment of the spent fuel treatment method of this invention.

DESCRIPTION OF THE PREFERRED EMBODIMENT

An embodiment of the invention will now be described with reference to the drawing.

The figure is a view showing an embodiment of the spent fuel treatment method of this invention, in which (1) represents a dissolving tank, (2) a solvent extraction process, (3) a plutonium nitrate solution and uranyl nitrate solution, (4) a freeze-vacuum drying apparatus, (5) a nitrate, (6) a condensate, (7) a denitrification process, (8) a roasting reduction process, (9) a product, (10) a spent solvent, (11) a freeze-vacuum drying apparatus, (12) TBP, DBP, etc., (13) n-dodecan, (14) a vacuum distillation apparatus, (15) DBP, etc., (16) TBP, (17) a preparation process, (18) an incinerator, (19) liquid waste, (20) a freeze-vacuum drying apparatus, (21) residue, (22) water and nitric acid, (23) storage or solid waste treatment system, (24) a preparation process, (25) a utilization process, and (26) an emission process.

In the drawing, nuclear fuel scrap which contains impurities generated at a fuel manufacturing plant or the like is supplied to (1) the dissolving tank along with a nitric acid solution, heated there and dissolved. Then uranium and plutonium solutions are sent to the solvent extraction process (2) after preparation. Solvents consisting of TBP, n-dodecan, etc., and the nitric acid solution are employed to effect separation into plutonium nitrate and uranyl nitrate solutions (3), spent solvent (10) and liquid waste (19).

The plutonium nitrate and uranyl nitrate solutions (3) are separated into nitrates (5) and condensate (6) by the freeze-vacuum drying process (4). The condensate (6) is fed to the freeze-vacuum drying apparatus (4). Meanwhile, the nitrates (5) are sent to the denitrification process (7). After microwave heating, for example, for conversion to oxide, powder is prepared as needed by the roasting reduction process (8) employing a roasting reduction furnace or the like. The result is the product (9).

Spent solvent (10) is separated into TBP, DBP, etc. at (12) and into n-dodecan (13) by freeze-vacuum drying apparatus (11). TBP, OBP (12) are separated into DBP, etc. (15) and TBP (16) by the vacuum distillation apparatus (14). DBP, etc. (15) is sent to the incinerator (18).

Meanwhile, TBP (16) and n-dodecan (13) are blended in the preparation process (17) and the result is sent to the solvent extraction process (2) after preparation by the further addition of TBP, n-dodecan and so on as necessary.

Liquid waste (19) is sent to the freeze-vacuum drying apparatus (20) and separated into residue (21) consisting of plutonium, uranium and americium impurities and the like, and into water and nitric acid (22). For recovery, residue (nitrates) (21) is sent to storage at process (23) or to a solid waste treating system. At the preparation process (24), water and nitric acid (22) are prepared by either concentration or dilution by means of adding water or nitric acid as necessary. The result is used at the process (25) and is also sent to, e.g., the dissolving tank (1), the solvent extraction tank (2) or another process, such as an off-gas scrubbing process, not shown. If there is a surplus, this can be released at the process (26).

In the embodiment described above, the freeze-vacuum dry apparatus is employed at three points, namely (4), (11) and (20). However, if the system is operated with storage tanks provided, a single freeze-vacuum drying apparatus would of course be quite satisfactory.

In accordance with the present invention, TBP, DBP and the like and n-dodecan can be separated by using a freeze-vacuum drying method in a solvent cleansing process, TBP and DBP can be separated by using a vacuum evaporation method in the solvent cleansing process, and the use of sodium can be eliminated. As a result, the amount of liquid radioactive waste is reduced, it is possible to abbreviate treatment, the amount of sludge produced is reduced and neutralization and filtration are unnecessary. By treating the liquid radioactive waste using a freeze-vacuum drying process having a high decontamination efficiency, most of the radioactive substance can be recovered as residue, the recovered solution can be reutilized, liquid waste can be reduced and liquid waste treatment simplified. Furthermore, plutonium and uranium solutions are recovered as nitrates by the freeze-vacuum drying method, and these solutions are rendered into oxides by thermal decomposition, thereby obtaining a powdered oxide product.

As many apparently widely different embodiments of the present invention can be made without departing from the spirit and scope thereof, it is to be understood that the invention is not limited to the specific embodiments thereof except as defined in the appended claims.

What is claimed is:

1. In a method for recovering plutonium and uranium from spent nuclear fuel scrap comprising dissolving the scrap in nitric acid to form a solution containing plutonium nitrate and uranyl nitrate, separating the nitrates from said solution and converting the nitrates to plutonium and uranyl oxides, the improvement comprises extracting the nitric acid containing the plutonium nitrate and the uranyl nitrate with a solvent consisting of tri-n-butyl phosphate, dibutyl phosphate and n-dodecane, subsequently removing said nitrates from said solvent, freeze-drying said solvent to separate the n-dodecane from the phosphates and separating the phosphates from each other and residual impurities by fractional distillation.

* * * * *